US009130323B2

(12) United States Patent
Kim

(10) Patent No.: US 9,130,323 B2
(45) Date of Patent: Sep. 8, 2015

(54) MOUNTING STRUCTURE AND METHOD OF CONNECTOR FOR FLEXIBLE CABLE

(71) Applicant: Molex Incorporated, Lisle, IL (US)

(72) Inventor: Suk Min Kim, Ansan (KR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 14/294,224

(22) Filed: Jun. 3, 2014

(65) Prior Publication Data

US 2014/0363990 A1 Dec. 11, 2014

(30) Foreign Application Priority Data

Jun. 7, 2013 (KR) ..... 10-2013-0065152

(51) Int. Cl.

| | |
|---|---|
| ***H01R 12/00*** | (2006.01) |
| ***H01R 12/88*** | (2011.01) |
| ***H01R 12/79*** | (2011.01) |
| *H01R 12/57* | (2011.01) |

(52) U.S. Cl.

CPC ..... *H01R 12/88* (2013.01); *H01R 12/79* (2013.01); *H01R 12/57* (2013.01); *Y10T 29/49147* (2015.01)

(58) Field of Classification Search

CPC ..... H01R 12/78; H01R 12/79; H01R 12/88; H01R 12/57

USPC ..... 439/67

See application file for complete search history.

(56) References Cited

U.S. PATENT DOCUMENTS

| | | | | |
|---|---|---|---|---|
| 6,042,392 | A | 3/2000 | Tsuji | |
| 6,099,346 | A * | 8/2000 | Hashiguchi et al. | 439/495 |
| 6,394,838 | B1 * | 5/2002 | Yen | 439/492 |
| 7,077,691 | B2 | 7/2006 | Yokoo et al. | |
| 7,303,429 | B2 | 12/2007 | Kim | |
| 7,909,630 | B2 * | 3/2011 | Yamada | 439/260 |
| 2006/0178039 | A1 * | 8/2006 | Chen | 439/495 |

FOREIGN PATENT DOCUMENTS

| | | | |
|---|---|---|---|
| JP | 06-29065 | U | 4/1994 |
| JP | 09-171857 | A | 6/1997 |
| JP | 2000-036708 | A | 2/2000 |
| JP | 2004-214093 | A | 7/2004 |
| JP | 2007-173043 | A | 7/2007 |
| JP | 2010-003645 | A | 1/2010 |
| JP | 2010-272226 | A | 12/2010 |
| KR | 1221506 | | 1/2013 |

* cited by examiner

*Primary Examiner* — Jean F Duverne

(57) ABSTRACT

The flexible cable mounting structure of the Present Disclosure is a flexible cable connector comprising a housing, whereon a contact terminal is mounted that enables insertion and withdrawal of the flexible cable and contact with the flexible cable. An actuator that opens/closes is installed in such a way as to enable rotation on the housing. A fitting nail is furnished on the housing and fixes the housing to the PCB. The fully-assembled flexible cable connector, wherein the contact terminal, actuator, and fitting nail have each been mounted to the housing, passes through from the bottom to the top of the PCB, and the bottom of the contact terminal and bottom of the fitting nail are soldered to the lower surface of the PCB.

15 Claims, 5 Drawing Sheets

MOUNTING STRUCTURE AND METHOD OF CONNECTOR FOR FLEXIBLE CABLE

REFERENCE TO RELATED APPLICATIONS

The Present Disclosure claims priority to prior-filed Korean Patent Application No. 10-2013-0065152, entitled "Mounting Structure And Method Of Connector For Flexible Cable," filed on 7 Jun. 2013 with the Korean Patent Office. The content of the aforementioned Patent Application is incorporated in its entirety herein.

BACKGROUND OF THE PRESENT DISCLOSURE

This Present Disclosure relates, generally, to a flexible cable connector, and, more specifically, to a mounting structure and method for a flexible cable connector wherein the cable is mounted on the upper surface of a printed circuit board (PCB), but the soldering takes place on the lower surface of the PCB.

In order to increase the degree of design freedom in information technology products and the like, the use of flexible printed circuits or flexible flat cables, rather than rigid PCBs, has become widespread. Typically, a connector is used in order to electrically connect a flat circuit cable of this type with a PCB.

Recently, as the thickness of electronic products with parts mounted therewithin including flexible cable connectors has decreased, two-sided PCBs have gradually been replaced by one-sided PCBs. On one-sided PCBs, a pattern is formed only on the top, and there are no holes connecting top and bottom. The bottom serves only as a base, which has the advantage of reducing production costs. An example of a flexible cable connector being mounted to a one-sided PCB is disclosed in Korean Patent No. 1221506, applied for and registered by the Present Applicant. The content of this Patent is incorporated by reference in its entirety herein. In addition to this, due to the above-mentioned advantages, many flexible cables are mounted to one-sided PCBs.

However, although flexible cable connectors like that disclosed in the '506 Patent do have the above-mentioned advantages, it is often difficult to secure space between parts for soldering, because all parts must be soldered at the same time they are mounted.

SUMMARY OF THE PRESENT DISCLOSURE

The purpose of the Present Disclosure, devised in order to resolve the above-described disadvantages, is to provide an installation structure and method for a flexible cable connector that can enable sufficient soldering space for parts that are mounted to the PCB, by having the parts be mounted to the upper surface of the PCB, but have the soldering take place on the lower surface. Another object of the Present Disclosure is to provide an installation structure and method for a flexible cable connector that enables the flexible cable connector to be firmly mounted to the PCB because the soldering to the PCB takes place in four directions of the housing.

The flexible cable mounting structure of the Present Disclosure is a flexible cable connector comprising a housing, whereon a contact terminal is mounted that enables insertion and withdrawal of the flexible cable and contact with the flexible cable. An actuator that opens/closes is installed to enable rotation on the housing. A fitting nail is furnished on the housing that fixes the housing to the PCB. The fully-assembled flexible cable connector, wherein the contact terminal, actuator, and fitting nail have each been mounted to the housing, passes through from the bottom to the top of the PCB, and the bottom of the contact terminal and bottom of the fitting nail are soldered to the lower surface of the PCB.

The contact terminal protrudes toward the back of the housing and is soldered to the lower surface of the PCB. The fitting nail protrudes toward either side and the front of the housing and is soldered to the lower surface of the PCB. The flexible cable is inserted and withdrawn via the front face of the housing, and is rotated backward when the actuator is closed.

When the actuator closes, the terminus protrudes further toward the back than the back end of the housing. The protruding terminus contacts the upper surface of the PCB when the actuator is depressed, and the support projection that supports the actuator is made to protrude downward. The actuator has a closing prevention structure so that when the fully-assembled flexible cable connector penetrates the PCB, the actuator remains in its open state. Further, the actuator is fixed rotatably on the side fitting nail furnished on either side of the housing. In the part of the actuator rotation axle, which contacts the side fitting nail, that touches the top of the side fitting nail, a flat area is formed so that the actuator is kept open. When the flexible cable inserted, the flexible cable remains a distance from the PCB.

The method of the Present Disclosure for mounting a flexible cable connector comprises: (a) a step wherein a flexible cable is assembled by mounting a contact terminal, actuator, and fitting nail on a housing; (b) a step wherein the fully-mounted flexible cable connector is inserted into the connector through hole of the flipped PCB with the actuator in open state; (c) a step wherein the bottom end of the contact terminal protruding outside the housing and the bottom end of the fitting nail are soldered to the soldering surface so as to contact the lower surface of the PCB; (d) a step wherein after soldering, the PCB is flipped and a flexible cable is inserted into the housing; and (e) a step wherein the actuator is closed by rotating backwards. In step (b), the actuator remains in open state. In step (d), the actuator is further rotated forward so as to facilitate insertion of the flexible cable.

The flexible cable connector mounting structure and method of the Present Disclosure has the following effects. First, because the flexible cable connector is mounted to the upper surface of the PCB but soldering takes place on the lower surface of the PCB, it facilitates circuit configuration because sufficient soldering space for other parts that are mounted to the top of the PCB can be secured. Second, the flexible cable connector can be firmly mounted to the PCB because the soldering to the PCB takes place in the four directions of the housing. Specifically, if a conventional flexible cable connector was soldered to the upper surface of the housing, there were no problems in reliability of mounting even through it was only soldered to the PCB in three directions of the housing. But, if the soldering took place on the lower surface of the PCB, then if the soldering took place only in three directions of the housing, then when the actuator was depressed in order to close it, the reliability of the connector mounting was unavoidably impaired; this can be resolved by soldering in four directions of the housing.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
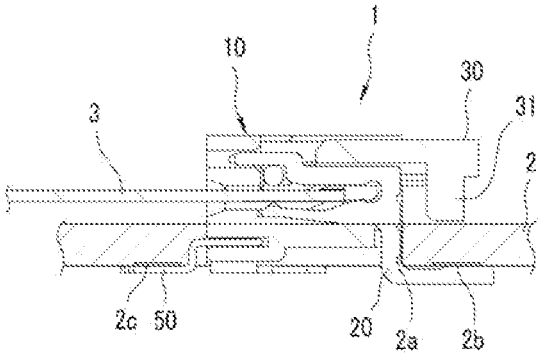
FIG. 1 is a cross-section of a flexible cable connector mounting structure according to a preferred embodiment of the Present Disclosure.
Figure 2:
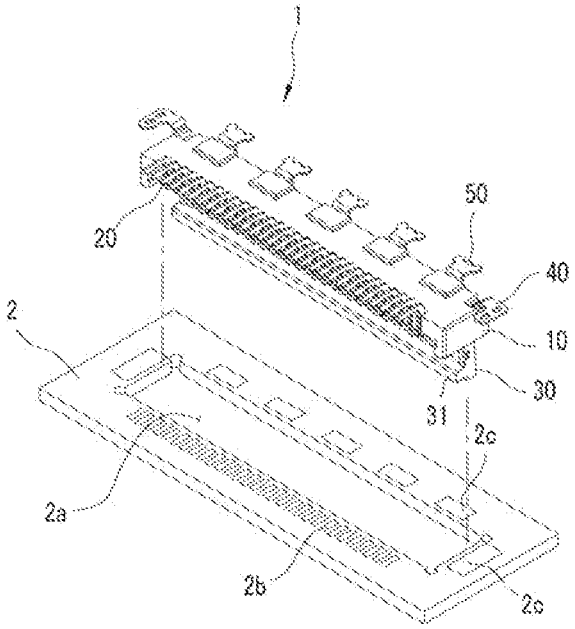
FIG. 2 is an oblique view showing the flexible cable connector of FIG. 1, separated from a printed circuit board.
Figure 3:
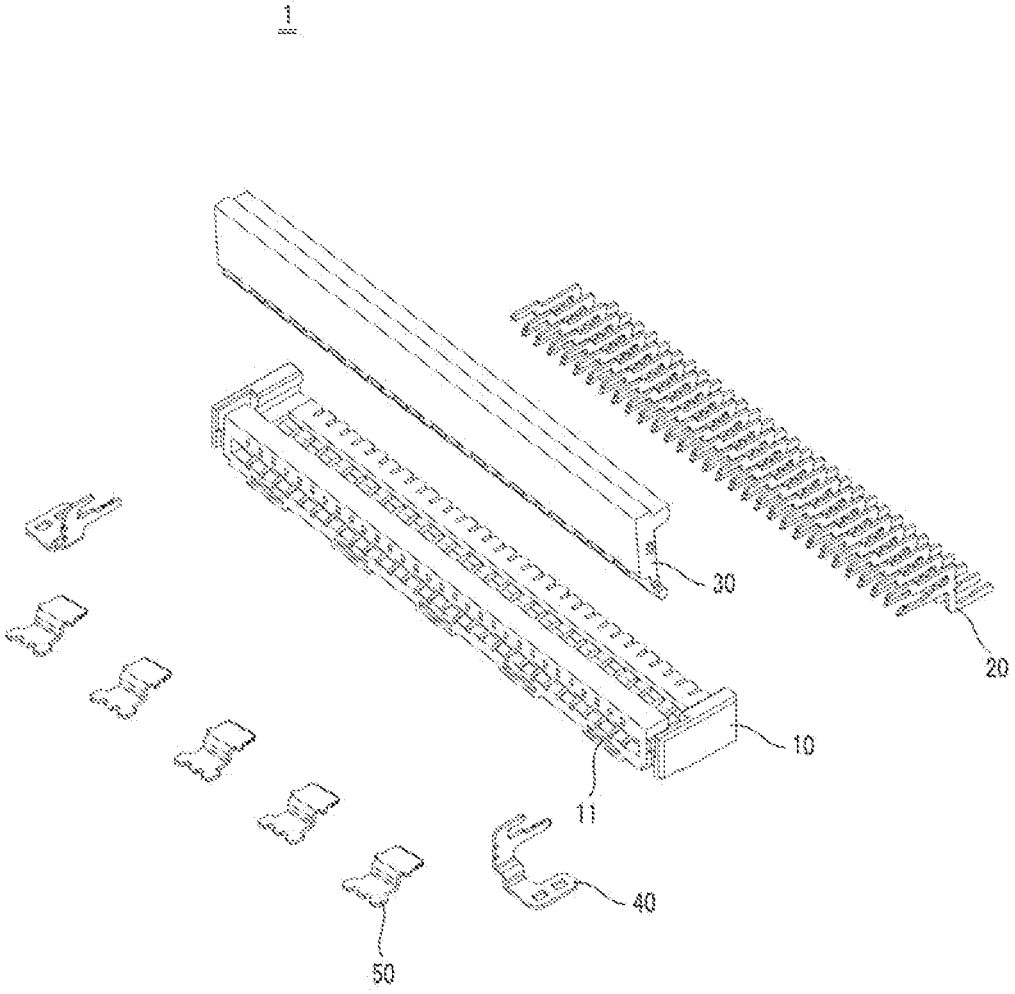
FIG. 3 is an exploded oblique view of the flexible cable connector of FIG. 1.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

With reference to the Figures, according to the flexible cable connector mounting structure of the Present Disclosure, the connector 1 penetrates the PCB 2 with the housing 10, contact terminal 20, actuator 30 and fitting nails 40, 50 assembled. The connector 1 then is mounted on the PCB 2 passing through the PCB 2 from below to above. The actuator 30 and the part of the housing 10 whereinto the flexible cable 3 is inserted are located on the top of the PCB 2. The terminus of the contact terminal 20 protrudes beyond the housing 10, and the bottoms of the fitting nails 40, 50 are soldered to the lower surface of the PCB 2. A connector through hole 2*a* is formed on the PCB 2 wherethrough the connector 1 penetrates. Solder surfaces 2*b*, 2*c*, where soldering takes place are formed near the connector through hole 2*a* on the lower surface of the PCB 2. When the flexible cable 3 is inserted into the housing 10, the flexible cable 3 can be readily inserted and withdrawn because the flexible cable 3 is set apart from the PCB 2.

As shown in FIG. 1, when the actuator 30 closes, the terminus protrudes backward beyond the back of the housing 10. On the protruding terminus, a support projection 31 protrudes backward that supports the actuator 30 while contacting the upper surface of the PCB 2 when the actuator 30 is depressed. The location where the support projection 31 makes contact should preferably be on the opposite side from the soldering surface 2*b* where the contact terminal 20 is soldered. By means of this structure, when the actuator 30 is pressed closed by hand, deformation of these parts is prevented without causing any problem for the part that is soldered to the PCB 2.

As described above, the flexible cable connector 1 comprises a housing 10, contact terminal 20, actuator 30 and fitting nails 40, 50. The flexible cable can be inserted and withdrawn via the front part of the housing 10. The contact terminals 20 that contact the flexible cable are mounted to the housing 10 via the back part. The contact terminals 20 are mounted on the housing 10 to contact the flexible cable that is inserted into the housing 10. The bottom of the contact terminal 20 is soldered to the soldering surface (pattern) formed on the lower surface of the PCB.

The actuator 30 is installed rotatably on the housing 10, so that when it is open the flexible cable can be inserted and after the flexible cable has been inserted, it is closed by rotating backward, thus enabling the flexible cable to reliably make contact with the contact terminal 20. Because the actuator 30 tightly presses the flexible cable and the contact terminal 20 together when the actuator 30 is in closed position, the contact between the flexible cable and the contact terminal 20 remains stable unless the flexible cable is manually pulled out.

The fitting nails 40, 50 are furnished on the housing 10 to hold the housing 10 firmly to the PCB 2, and comprise a pair of side fitting nails 40 fixed to either side of the housing 10, and a plurality of front fitting nails 50 fixed to the front part of the housing 10. On either side of the housing 10, the side fitting nails 40 are affixed in a sliding fashion. On the front of the housing 10, a plurality of fitting nail holding grooves 11 are formed at a distance from one another, whereinto the front fitting nails 50 are inserted.

Figure 4:
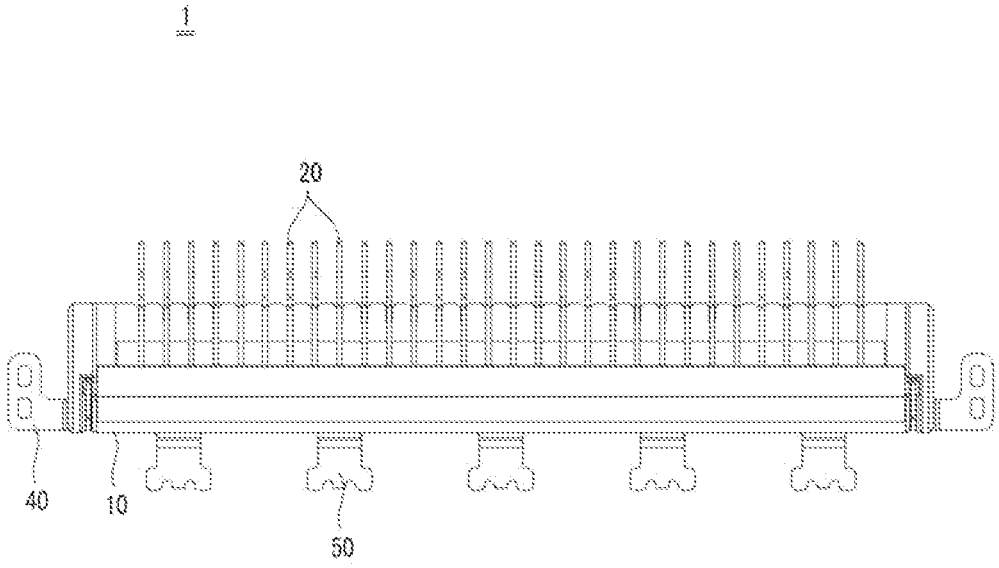
FIG. 4 is a bottom view of the flexible cable connector of FIG. 1.

As shown in FIG. 4, when the contact terminal 20, side fitting nails 40 and front fitting nails 50 are assembled on the housing 10, the bottom parts thereof protrude beyond the housing 10. Specifically, the bottom of the contact terminal 20 protrudes behind the housing 10, the side fitting nails 40 protrude to either side of the housing 10, and the front fitting nails 50 protrude in front of the housing 10.

Figure 5:
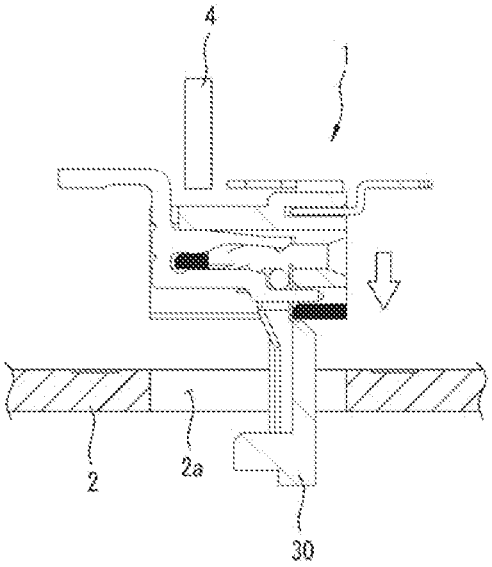
FIGS. 5-8 show the process of mounting the flexible cable connector of FIG. 1.

Before the flexible cable connector 1 is mounted, an assembly process is conducted wherein the contact terminal 20, actuator 30 and fitting nails 40*m* 50 are assembled on the housing 10. After the flexible cable connector 1 has been assembled, as shown in FIG. 5, the connector 1 is inserted into the connector through hole 2*a* of the PCB 2 from above to below (from the lower surface to the upper surface of the PCB), with the PCB 2 flipped and the flexible cable connector 1 that was assembled using the pickup nozzle 4 also in a flipped state. The actuator 30 must be opened vertically, as shown in the Figures, in order for the actuator 30 not to catch on the entrance to the connector through hole 2*a* in the insertion process.

Because the terminus of the actuator 30 protrudes backward from the housing 10, if the connector 1 is inserted when the actuator 30 is in closed position, the terminus of the actuator 30 catches on the connector through hole 2*a*, and consequently the connector 1 is inserted when the actuator 30 has been opened.

Figure 6:
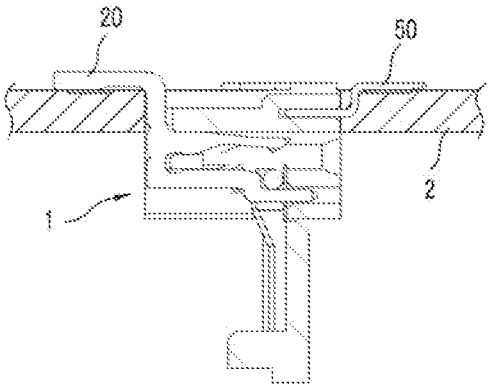
Figure 7:
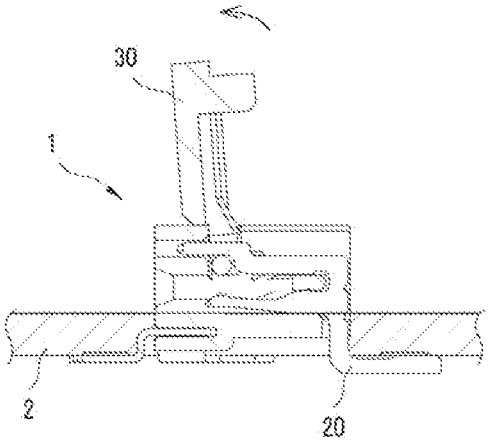

As shown in FIG. 6, if the assembled flexible cable connector 1 has been entirely inserted, the bottoms of the contact terminals 20 that protrude outward from the housing 10 and the bottoms of the fitting nails 40, 50 respectively are contacted and soldered to the soldering part formed on the lower surface of the PCB 2. After soldering has been conducted, as shown in FIG. 7, the PCB 2 is flipped over and the actuator 30 in vertical state is further rotated forward to open it further, so that the flexible cable can be readily inserted.

Figure 8:
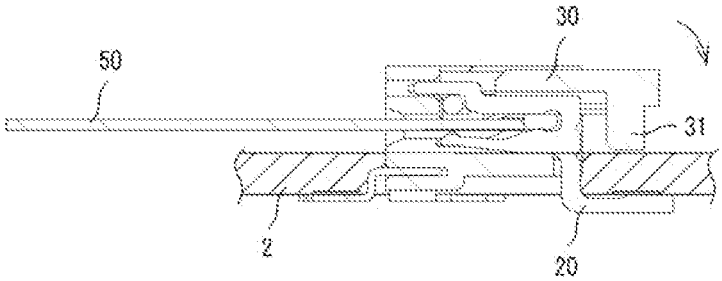
Figure 9:
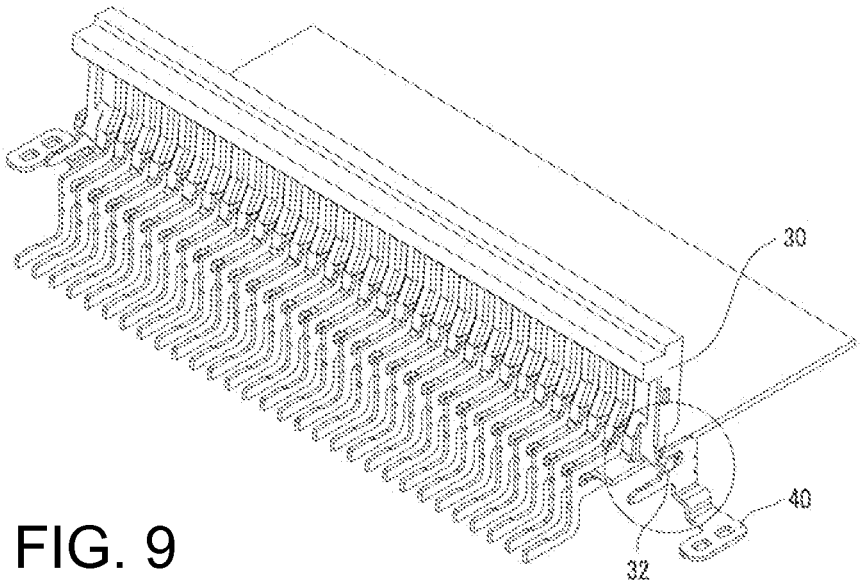
FIG. 9 is a partial cutaway view of the housing in order to show the state in which the actuator is rotatably coupled to the side fitting nail.
Figure 10:
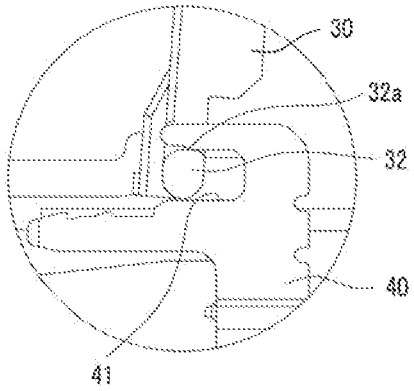
FIG. 10 shows the state in which the respective sides of the actuator are rotatably coupled to the side fitting nail.

After the actuator 30 has been fully opened, as shown in FIG. 8, the flexible cable 3 is inserted, and the actuator 30 is closed by rotating backward. As the actuator 30 is closed, the flexible cable 3 and contact terminals 20 are firmly pressed together for a stable connection. In the process of closing the actuator 30, the terminus of the actuator 30 is depressed by hand; the support projection 31 formed on the terminus of the actuator 30 is contacted with the upper surface of the PCB 2 to support the actuator 30.

At the top end of the side fitting nails 40, a rotation axle insertion part 41 is formed in the form of a hole whereinto the rotation axle 32 formed on either side of the actuator 30 is inserted. The rotation axle insertion part 41 has a shape that is opened toward the back.

When the actuator 30 is opened vertically, the part of the exterior surface of the rotation axle 32 that touches the top of the rotation axle insertion part 41 is formed as a flat space 32*a*. Accordingly, when the actuator 30 is opened vertically, the actuator 30 is kept in its vertically opened state, preventing closure, unless the actuator 30 is pushed manually.

According to the above-described flexible cable connector mounting structure and method of the Present Disclosure, the following technical characteristics can be expected. First, because the flexible cable connector 1 is mounted to the upper surface of the PCB 2, but soldering takes place on the lower surface of the PCB 2, it facilitates circuit configuration because sufficient soldering space for other parts that are mounted to the upper surface of the PCB 2 can be secured. Especially pronounced effects can be obtained if parts are mounted to only one side of the PCB 2 for purposes of enhancing the thinness of the electronic product.

Second, the flexible cable connector 1 can be firmly mounted to the PCB 2 because the soldering to the PCB 2 takes place in four directions of the housing 10. Specifically, if a conventional flexible cable connector was soldered to the top surface of the housing, there were no problems in reliability of mounting even through it was only soldered to the PCB 2 in three directions of the housing. However, if the soldering took place on the lower surface of the PCB, then if the soldering took place only in three directions of the housing, then when the actuator was depressed in order to close it, the reliability of the connector mounting was unavoidably impaired. This can be resolved by the Present Disclosure by adding front fitting nails 50 and soldering in four directions of the housing 10.

While a preferred embodiment of the Present Disclosure is shown and described, it is envisioned that those skilled in the art may devise various modifications without departing from the spirit and scope of the foregoing Description and the appended Claims.

What is claimed is:

1. A flexible cable connector mounting structure, the mounting structure comprising:

a housing, whereon contact terminals are mounted, the contact terminals enabling insertion and withdrawal of the flexible cable and contact with the flexible cable;

an actuator, the actuator mounted to enable rotation on the housing; and fitting nails, the fitting nails being furnished on the housing and affixing the housing to a printed circuit board (PCB);

wherein, when the flexible cable connector is fully assembled, each contact terminal, the actuator and the fitting nail are mounted to the housing, and the flexible cable connector passes through from the bottom to the top of the PCB, and the bottom of each contact terminal and of each fitting nail are soldered to the lower surface of the PCB.

2. The mounting structure of claim 1, wherein each contact terminal protrudes backward from the housing and is soldered to the bottom surface of the PCB.

3. The mounting structure of claim 2, wherein each fitting nail protrudes forward and to either side of the housing and is soldered to the lower surface of the PCB.

4. The mounting structure of claim 3, wherein the actuator is rotated backward when closing.

5. The mounting structure of claim 4, wherein, when the actuator closes, each contact terminal protrudes further toward the back than a back end of the housing.

6. The mounting structure of claim 5, wherein the protruding contact terminal contacts the upper surface of the PCB when the actuator is depressed, and the support projection that supports the actuator is made to protrude downward.

7. The mounting structure of claim 6, further including a closure prevention structure to keep the actuator in an open state when the fully-assembled flexible cable connector passes through the PCB.

8. The mounting structure of claim 7, wherein the actuator is fixed rotatably on the fitting nails furnished on either side of said housing.

9. The mounting structure of claim 8, wherein a flat area is formed in a part of a rotation axle of the actuator that touches the top of the fitting nails, so that the actuator is kept in its open state.

10. The mounting structure of claim 9, wherein the flexible cable connector is set apart from the PCB.

11. A method for mounting a flexible cable connector, comprising:

assembling a flexible cable connector by mounting a contact terminal, an actuator and a fitting nail on a housing; and inserting the flexible cable connector into a connector through hole of a flipped printed circuit board (PCB) with the actuator in open state;

wherein a bottom end of the contact terminal protrudes outside the housing and a bottom end of the fitting nail are soldered to a soldering surface, so as to contact the bottom surface of said PCB.

12. The method of claim 11, wherein, after soldering, the PCB is flipped and a flexible cable is inserted into the housing.

13. The method of claim 12, wherein the actuator is closed by rotating backwards.

14. The method of claim 13, wherein the actuator is initially kept in an open state.

15. The method of claim 14, wherein the actuator is then rotated forward to facilitate the insertion of the flexible cable.

* * * * *